US011358265B2

(12) United States Patent
Carrington

(10) Patent No.: US 11,358,265 B2
(45) Date of Patent: Jun. 14, 2022

(54) TACTICAL ENTRY AND RESCUE MULTI-TOOL

(71) Applicant: Brian Carrington, Temecula, CA (US)

(72) Inventor: Brian Carrington, Temecula, CA (US)

( * ) Notice: Subject to any disclaimer, the term of this patent is extended or adjusted under 35 U.S.C. 154(b) by 0 days.

(21) Appl. No.: 16/937,143

(22) Filed: Jul. 23, 2020

(65) Prior Publication Data

US 2021/0060752 A1 Mar. 4, 2021

Related U.S. Application Data

(60) Provisional application No. 62/891,711, filed on Aug. 26, 2019.

(51) Int. Cl.
*B25F 1/00* (2006.01)
*E04G 23/08* (2006.01)

(52) U.S. Cl.
CPC ..... *B25F 1/006* (2013.01); *E04G 23/08* (2013.01); *E04G 2023/085* (2013.01)

(58) Field of Classification Search
CPC ..... B25F 1/006; B25F 7/144
USPC ..... 7/144, 145, 158, 143, 166
See application file for complete search history.

(56) References Cited

U.S. PATENT DOCUMENTS 606,547 A * 6/1898 Hillman ..... B25D 1/00
4,287,623 A * 9/1981 Tarran ..... B23D 29/02 7/158
5,105,493 A * 4/1992 Lugtenaar ..... A01D 11/00 15/141.1
10,682,749 B2 * 6/2020 Rittenhouse ..... B25F 1/006
2013/0139325 A1 * 6/2013 Walker ..... B25F 1/006 7/145
2016/0023345 A1 * 1/2016 Ori, III ..... B25C 11/00 7/143
2016/0176036 A1 * 6/2016 Langan ..... B25J 1/04 2/422

OTHER PUBLICATIONS

Paulo, S7, D2, A2: Difference in tool steel properties, 2018, www.paulo.com/university-resources/s7-d2-a2-difference-tool-steel-properties/ (Year: 2018).*
Axeing.org, "Best Tactical Axe", Oct. 27, 2015, Retrieved from: http://axeing.org/best-tactical-axe/.

* cited by examiner

*Primary Examiner* — Monica S Carter
*Assistant Examiner* — Sarah Akyaa Fordjour
(74) *Attorney, Agent, or Firm* — Berenato & White, LLC

(57) ABSTRACT

A tactical entry multi-tool for first responders is disclosed. The tool can be used to breach encountered obstacles. The tool can include an axe blade, hammer head, breaching wedge, "T" slot connector/wrench, and a handle assembly. The axe blade and hammer head are located at the top of the tool with the breaching wedge located at the bottom at a fixed angle. The axe blade is located opposite of the hammer head with a sturdy handle located between the two in a generally T shaped orientation. The handle assembly is located along the shaft of the tool. The "T" slot is located between the axe and hammer, and has the dual function of being a wrench to open/close valves, and acting as a slot to insert the breaching wedge of a second tool for additional force. The multi-tool may be configured from a single piece of high-performance metal.

14 Claims, 5 Drawing Sheets

TACTICAL ENTRY AND RESCUE MULTI-TOOL

This application claims the benefit of U.S. Provisional Application 62/891,711, filed Aug. 26, 2019, which is incorporated herein by reference.

BACKGROUND

1. Field of the Invention

The invention relates generally to tactical entry and rescue multi-tools. Specifically, the invention relates to an axe style, hand carried and wielded, tactical entry tool.

2. Background

Currently there exists a number of tactical entry tools to assist first responders in gaining entry to otherwise sealed or closed structures. Known solutions use a device to attempt to breach obstacles; i.e., doors, windows, walls, roofs, bars, etc. But these solutions fail to meet the needs of the industry because they are typically not sufficiently durable, versatile, light weight, or sufficiently portable to effectively and rapidly breach the variety of obstacles encountered. Current tools are often longer, i.e., reducing mobility of the tool user, heavier, i.e., where use is limited by the physical strength and endurance of the user; and, more expensive, i.e., limiting the scope of use of those who may need such a tool by virtue of whether a particular budget does or does not provide or support the acquisition. Other off-the-shelf solutions, i.e., an axe or hatchet or crowbar, are sometimes re-purposed to meet the need in the interim, but are not optimized to meet all the breaching needs faced by the industry (i.e., firefighters, police, rescue, etc.). These known tools are single purpose solutions for specific needs such as hacking, or prying, or hammering, or cutting, or opening/closing valves. In short, they fail to meet the industry need because they are too single purpose and are not designed nor intended for being multipurpose breaching tools.

SUMMARY OF THE INVENTION

First/rescue/police responders have a need for a tactical entry multi-tool when faced with a variety of obstacles that need to be rapidly breached. It would also be desirable to have a single stand-alone entry tool that simultaneously combines several ways to breach obstacles, that is light weight, compact, portable, and optimized for compromising most encountered obstruction materials including, for example, partially metallic and even full metal structures.

The invention is a tactical entry multi-tool, which in one embodiment can include the following components: (1) an axe blade; (2) a hammer head, located opposite the axe blade; (3) a breaching wedge, located at the bottom of the tool, orientated at an angle (preferably a perpendicular angle) from the axe and opposed hammer portion of the tool; (4) a T slot force multiplier for inserting and effectively engaging a second tool; and, (5) and (4) also functioning as a valve wrench. The main shaft portion of the tool is preferably a high-performance treated fibre-glass or metal or combination thereof. Components (1) thru (5) can be assembled and connected, i.e., like a conventional hammer/hatchet/axe; or can be made of a single piece of metal or suitably reinforced material, i.e., fiberglass with suitable reinforcing and hardened metallic edges for cutting and piercing.

The device may, in addition, also have one or more of the following: (6) a sheet metal ripper located on the beard of the axe blade; (7) a spanner wrench cut out located under the hammer portion of the tool; (8) an I beam style shaft design for strength and weight reduction; (9) a vibration reduction material integrated into or onto the shaft; and, (10) a tanto style, i.e., multi-bevel, axe blade.

The disclosed device better meets the needs of the industry by providing multiple solutions in a single easily carried versatile tool. It provides: (1) a lightweight solution to breaching needs (2) a solution that is easily portable (3) a structural design that is durable (4) an all-in-one multi-solution device.

The disclosed device can combine in a single embodiment: (1) axe blade treated and optimized for piercing metal; (2) a "T" slot leverage multiplier for increased force during use; (3) a sheet metal ripper on the back side of axe blade; (4) a spanner wrench; and, (5) a shaped perpendicular breaching wedge. In addition, the overall design that is optimized for compactness and efficiency.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The Tactical entry and rescue multi-tool may, however, be embodied in many different forms and should not be construed as being limited to the embodiments set forth herein; rather, these embodiments are provided by way of illustration only and so that this disclosure will be thorough, complete and fully convey understanding to those skilled in the art.

DETAILED DESCRIPTION

Figure 1:
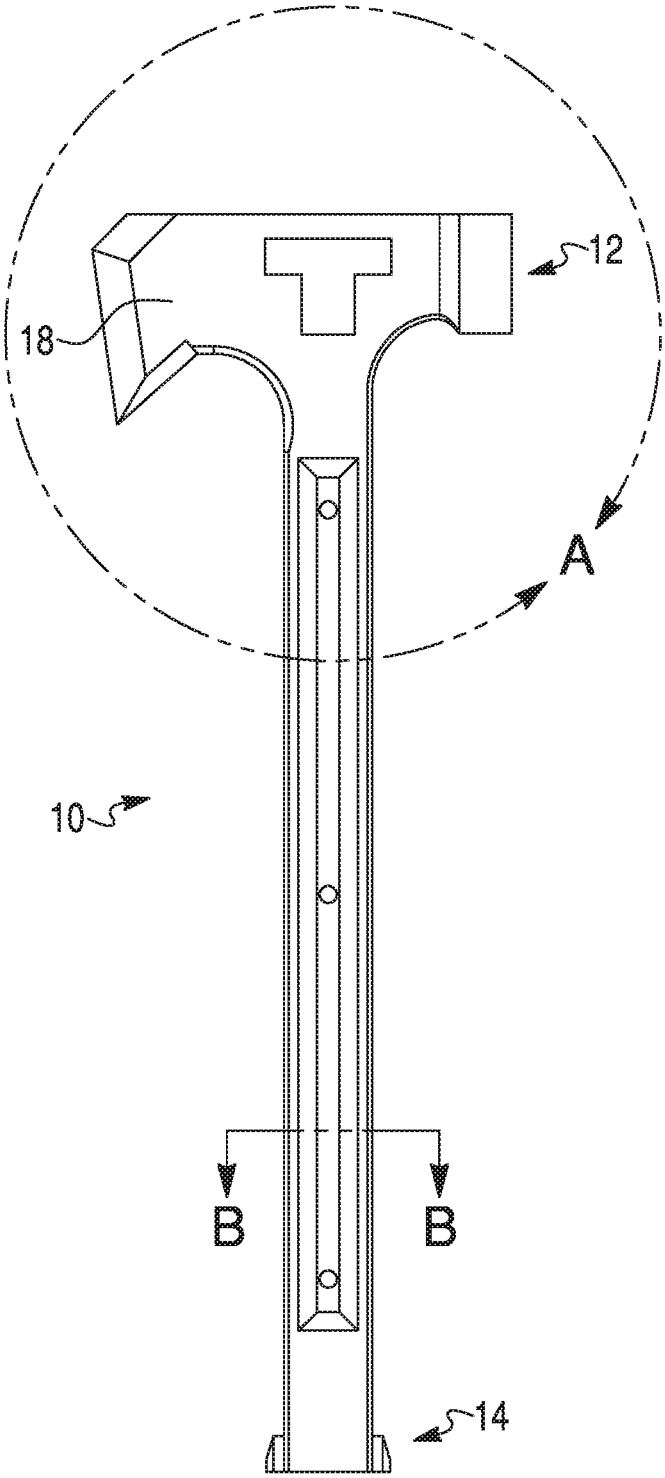
FIG. 1. is a front plan view of the tool.
Figure 2:
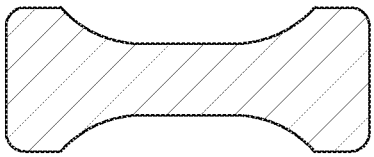
FIG. 2. Is a cross section shown at BB of FIG. 1
Figure 3:
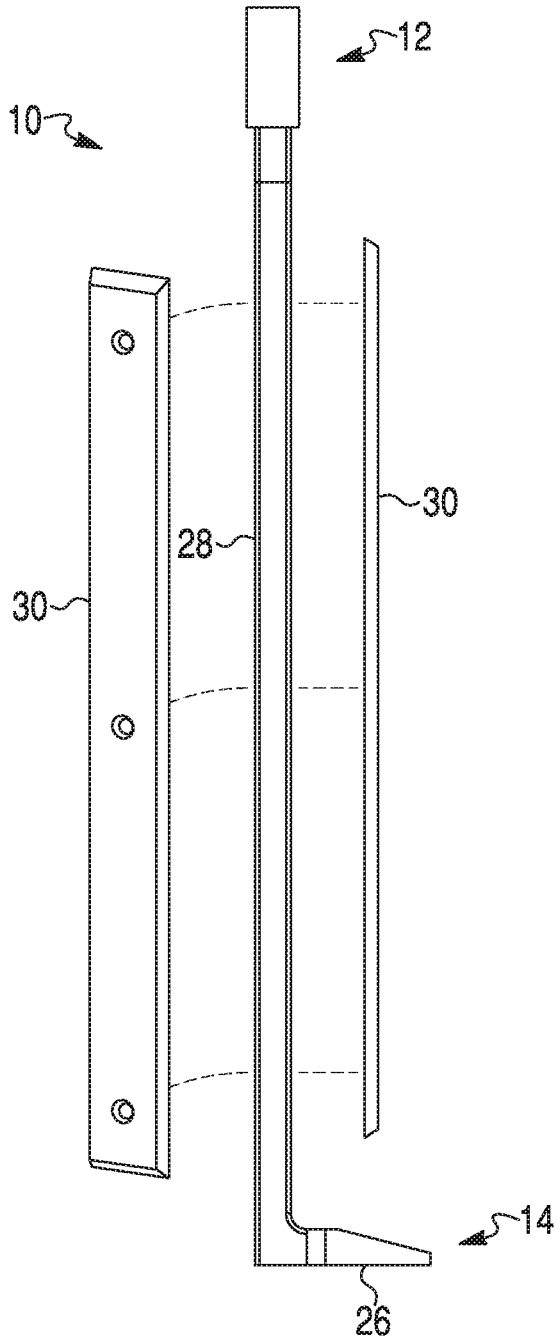
FIG. 3 is an exploded side view of the tool.
Figure 4:
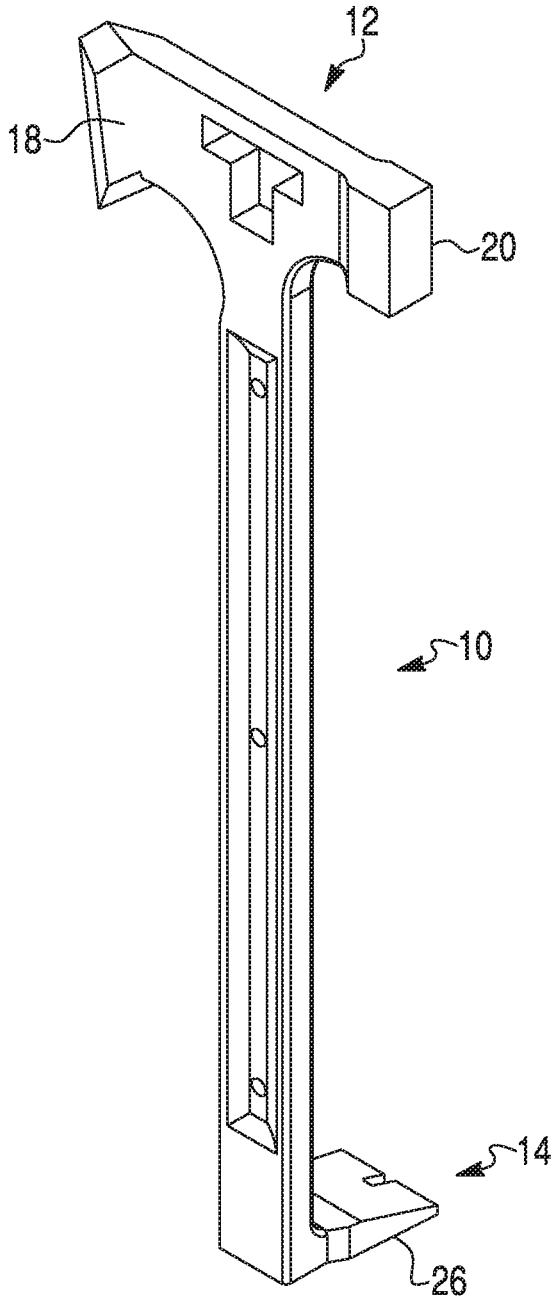
FIG. 4 is an oblique rearward view of the tool in FIG. 1.
Figure 5:
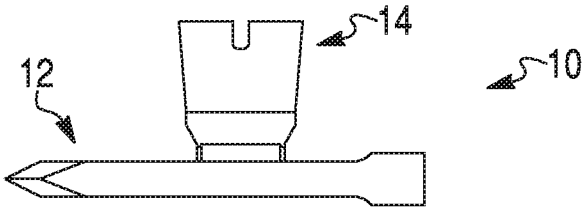
FIG. 5 is a top view of the tool.
Figure 6:
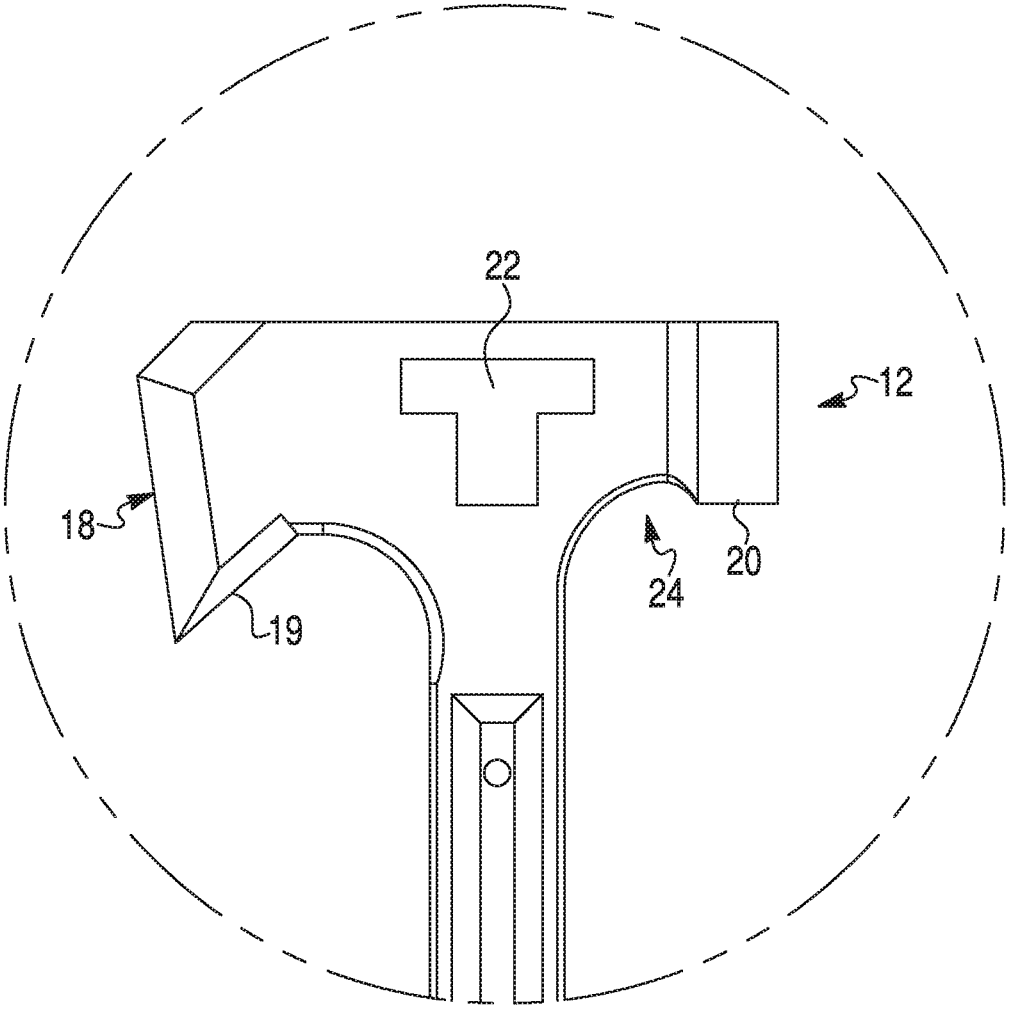
FIG. 6 is a detailed view of the head of the tool shown in FIG. 1.

With reference to FIGS. 1-8.

The present invention is directed to tactical entry and rescue multi-tool 10 including two ends 12, 14 and strong resilient shaft element 16 connected therebetween. The top head end 12 of the tool 10 resembles a hatchet or axe head 18, and includes hammer 20 opposed to the sharpened side of the tool 18 and a T-slot passageway 22 positioned between the respective opposed heads. The hacking or sharpened side of the head may further include a metal ripper 19 (i.e., a sharpened pointed cutter to penetrate metal) and an opposed multi-sized spanner shaped wrench slot 24.

The opposed, or bottom, end 14 of the tool 10 includes a prying wedge element 26 arranged at an angle to the shaft 28 that connect the top 12 to the bottom 14. This wedge can be forced into surfaces using the hammer element of another tool 10, or can be forcefully swung into engagement into a slot or gap or dug or spiked into a penetrable surface. The tool shaft 28 can be a separate, preferably metal element, or suitably reinforced wood or glass fibre, etc., and may have handle covers 30 attached thereto enhance grip and reduce vibration.

Figure 7:
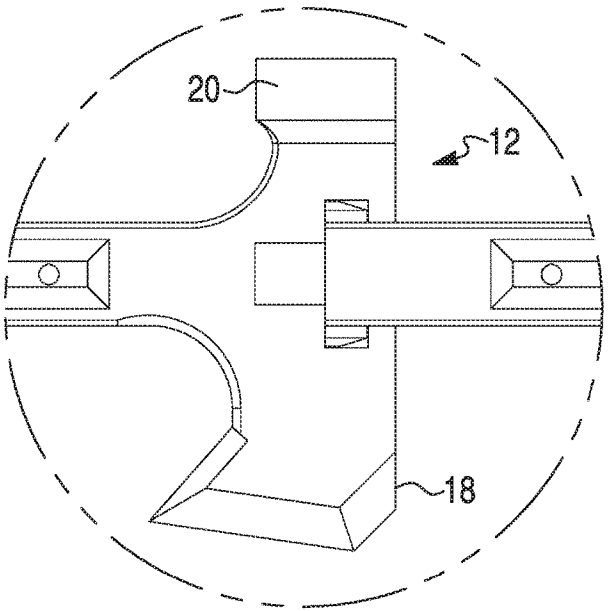
FIG. 7 is a detailed viewed of a linked pair of tools.
Figure 8:
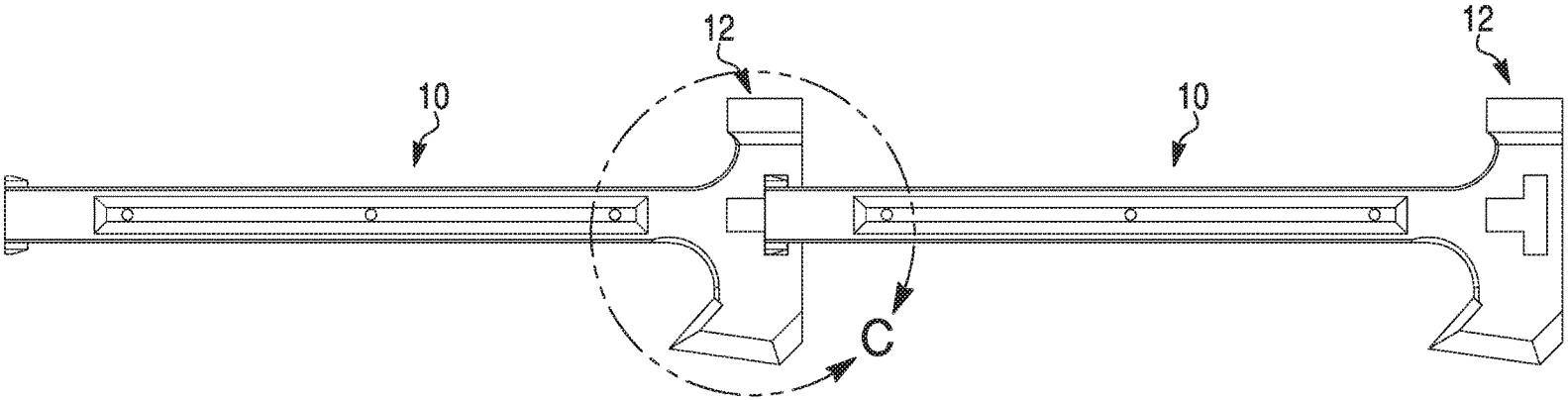
FIG. 8 shows two tools linked end to end.

The T-slot 22 makes possible the linking of two or more tools 10 end-to-end, longitudinally or at 90 degrees, to greatly increase/enhance leverage and breaching ability of the tool(s) as compared to when one tool is used alone. A lower or bottom end 14 of one tool can be linked end-to-end to the axe/hammer 12 end of another as shown in FIGS. 7 & 8.

In its most complete version, the multi-tool is preferably made up of a single piece of stamped or forged metal with the following components: (1) a tanto style, i.e., more than one cutting/piercing bevel, axe blade; (2) with a sheet metal ripper located on the beard of the axe blade (3) a hammer head which is located opposite of the axe blade; (4) a T slot force multiplier for inserting a second tool, but which slot can also act/perform as a valve wrench, located between the axe blade and hammer; (5) a spanner wrench cut out located under the hammer portion of the tool (6) the shaft of the tool with an I beam design for strength and weight reduction; (7) an anti-vibration element integrated into the shaft; (8) a handle assembly covering shaft with additional anti-vibration material; (9) a breaching wedge located at the bottom of the shaft of the tool and orientated at a perpendicular angle from the axe and hammer portion of the tool as shown, for example, in FIG. 5.

The tool overall length is preferably between 1.5-2.5 feet (18 inches being preferred), and weighs no more than 7 lbs, slightly less than 5 lbs being preferred. The overall width of the head from axe edge to hammer head is about 6 inches, head height would be on the order of 3.0 inches with the bearded part of the blade, the metal ripper taking up 1.0 inches of that vertical height, with a thickness on the order of 0.75 inches. The shaft 28 would be on the order of 0.5 inches thick at its thickest location and 0.25 inches thick in the center of the I-beam shape. The width of the shaft would be on the order of 1.25 inches. The bottom prying end 14 would have the prying element extend on the order 2 inches from the surface of the shaft 28, and a thickness/width adapted to engage the T-slot. The T-slot, used to connect other tools and to wrench open/closed gas valves, etc., would measure 1.80 inches across the top of the T shape, have a total T height on the order of 1.4-1.8 inches, with a width of the upper portion of the T slot at about 0.5 inches and the downward portion of the T width at about 0.75 inches. The metal chosen for stamping (forging) into the overall shape should be a suitable and resilient tool steel (i.e., for making hammers and axes, pry bars, etc.) with capacity for both sharpening and edge retention. For example: D-2 tool steel, or 4340 or 4140 or 4130 steel, or 1070 high carbon steel, or its equivalent, is preferred. The tool in its overall shape can be forged or stamped (from a steel slab ⅓ to ½ inches in thickness), and then finished via welding, grinding, machining, heat treating, and edging. Rubber or polymer or aluminum (6061 aluminum), or combination(s) thereof, handle covers would attach through holes to the center I-beam shaped shaft to provide shock and vibration attenuation when the tool is used. Solid aluminum is preferred as handle covers owing to its resistance to scuffing and cutting, and that the color of the tool can be easily changed by changing the aluminum color for the assembled handles.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by both this disclosure. It is indeed intended that the scope of this disclosure should be determined by a proper legal interpretation and construction of the disclosure, including equivalents, as understood by those of skill in the art relying upon the complete disclosure present at the time of filing.

What is claimed is:

1. A tactical entry multi tool, comprising:

a shaft connecting a top end and a bottom end of said tool;

said top end including an axe head shape wherein an axe blade is positioned opposite a hammer end and, in a connected portion of said top end between said axe head and hammer portions, said top end further comprising a T-shaped slot passageway passing side to side through said top end in a direction orthogonal to an orientation of said axe blade and hammer end;

said bottom end including a breaching wedge element angled and extending away from said shaft, said breaching wedge adapted to insert into a T-shaped slot of a second tactical entry multi tool, and connect said second tactical entry tool so as to create leverage multiplication.

2. A tool as in claim 1, further comprising:

a metal ripper on a beard portion of said axe blade.

3. A tool as in claim 2, further comprising:

a spanner shaped wrench feature positioned immediately below said hammer end.

4. A tool as in claim 3, wherein:

said shaft has an I-beam cross sectional shape.

5. A tool as in claim 4, further comprising:

a handle cover positioned to overlie and attach to a portion of said shaft between said top and bottom ends.

6. A tool as in claim in claim 1, wherein:

said axe blade is a Tanto style blade.

7. A tactical entry multi tool, comprising:

a shaft connecting a top end and a bottom end of said tool; said top end including an axe head shape wherein an axe blade is positioned opposite a hammer end and, in a connected portion of said top end between said axe head and hammer portions, said top end further comprising a T-shaped slot passageway passing side to side through said top end in a direction orthogonal to an orientation of said axe blade and hammer end; said bottom end including a breaching wedge element angled and extending away from said shaft, said breaching wedge adapted to insert into a T-shaped slot of a second tactical entry multi-tool and connect said second tactical entry tool so as to create leverage multiplication, wherein, said tool, in its entirety, is stamp forged from a single piece of resilient metal.

8. A tool as in claim 7, wherein:

said metal is selected from the group consisting of: D-2 tool steel, and 4340 and 4140 and 4130 steel, and 1070 high carbon steel or any combination thereof.

9. A tactical entry multi tool, comprising:

a shaft connecting a top end and a bottom end of said tool; said top end including an axe head shape wherein an axe blade is positioned opposite a hammer end and, in a connected portion of said top end between said axe head and hammer portions, said top end further comprising a T-shaped slot passageway passing side to side through said top end in a direction orthogonal to an orientation of said axe blade and hammer end; said bottom end including a breaching wedge element angled and extending away from said shaft, said breaching wedge adapted to insert into a T-shaped slot of a second tactical multi tool and connect said second tactical entry tool so as to create leverage multiplication, wherein, said tool is made from a reinforced fibre-glass with reinforced metal cutting, hammering and piercing portions.

10. A tool as in claim 9, further comprising:

a metal ripper on a beard portion of said axe blade.

11. A tool as in claim 10, further comprising:

a spanner shaped wrench feature positioned immediately below said hammer end.

12. A tool as in claim 11, wherein:

said shaft has an I-beam cross sectional shape.

13. A tool as in claim 12, further comprising:

a handle cover positioned to overlie and attach to a portion of said shaft between said top and bottom ends.

14. A tool as in claim in claim 13, wherein:

said axe blade is a Tanto style blade.

* * * * *